US010919743B2

(12) United States Patent
Baier et al.

(10) Patent No.: US 10,919,743 B2
(45) Date of Patent: Feb. 16, 2021

(54) FALL PROTECTION DEVICE FOR A HIST

(71) Applicant: J.D. Neuhaus Holding GmbH & Co. KG, Witten (DE)

(72) Inventors: Michael Baier, Mülheim an der Ruhr (DE); Alexander Koch, Castrop-Rauxel (DE); Ewald Sawitzki, Bochum (DE); Simon Brose, Hattingen (DE)

(73) Assignee: J.D. NEUHAUS HOLDING GMBH & CO. KG, Witten (DE)

( * ) Notice: Subject to any disclaimer, the term of this patent is extended or adjusted under 35 U.S.C. 154(b) by 157 days.

(21) Appl. No.: 16/461,916

(22) PCT Filed: Nov. 21, 2017

(86) PCT No.: PCT/EP2017/079940
§ 371 (c)(1),
(2) Date: May 17, 2019

(87) PCT Pub. No.: WO2018/095914
PCT Pub. Date: May 31, 2018

(65) Prior Publication Data

US 2019/0322500 A1 Oct. 24, 2019

(30) Foreign Application Priority Data

Nov. 22, 2016 (DE) ..... 10 2016 122 520

(51) Int. Cl.
*B66D 1/54* (2006.01)
*B66C 15/00* (2006.01)

(52) U.S. Cl.
CPC ..... *B66D 1/54* (2013.01); *B66C 15/00* (2013.01)

(58) Field of Classification Search
CPC ..... B66D 1/54; B66C 15/02
See application file for complete search history.

(56) References Cited

U.S. PATENT DOCUMENTS 4,225,012 A * 9/1980 Hindle ..... B66D 1/54 182/112
5,735,507 A * 4/1998 Sierra Escudero ..... B66C 15/02 254/391

(Continued)

FOREIGN PATENT DOCUMENTS

BE 820 000 A 3/1975
DE 82 555 A5 7/1895

(Continued)

OTHER PUBLICATIONS

International Search Report for Application No. PCT/EP2017/0799490, dated Mar. 5, 2018, in German with English translation (7 pages).

(Continued)

*Primary Examiner* — Emmanuel M Marcelo
(74) *Attorney, Agent, or Firm* — Nixon Peabody LLP

(57) ABSTRACT

A hoist, a hoisting apparatus with said hoist and a method for securing a hoist. A hoist body having a drive mechanism for raising or lowering a hoist chain or a hoist cable is suspended from a support device by a hoist support. A safety device having a loosely arranged coupling element and a damping element is mounted between the hoist body and the support device. If the hoist support is released, the hoist body can drop by a drop height until the coupling element becomes taut. The damping element then damps the fall under the load of the hoist body, the hoist chain and whatever load is suspended from it.

16 Claims, 9 Drawing Sheets

(56) References Cited

U.S. PATENT DOCUMENTS

| | | | | |
|---|---|---|---|---|
| 6,457,556 | B1 | 10/2002 | Skade | |
| 6,554,253 | B1 * | 4/2003 | Dobmeier | B62D 43/045 254/323 |
| 2002/0040979 | A1 * | 4/2002 | Raz | B66D 1/54 254/323 |
| 2014/0020983 | A1 | 1/2014 | Casebolt | |
| 2017/0030813 | A1 * | 2/2017 | Myers | G01N 3/08 |
| 2018/0162702 | A1 * | 6/2018 | O'Connor | B66C 15/02 |

FOREIGN PATENT DOCUMENTS

| | | | | |
|---|---|---|---|---|
| DE | 82555 | A5 | 6/1971 | |
| DE | 2445374 | A1 | 4/1976 | |
| DE | 34 32 043 | C2 | 7/1992 | |
| DE | 93 03 916 | U1 | 5/1993 | |
| DE | 195 19 788 | A1 | 3/1996 | |
| DE | 101 17 639 | C2 | 10/2002 | |
| DE | 20 2005 014 358 | U1 | 11/2005 | |
| DE | 603 19 875 | T2 | 3/2009 | |
| EP | 0 365 752 | A2 | 5/1990 | |
| FR | 2337096 | A1 * | 7/1977 | B66D 1/54 |
| WO | WO 2015/143544 | | 10/2015 | |

OTHER PUBLICATIONS

Written Opinion of International Searching Authority for Application No. PCT/EP2017/079940, dated Mar. 5, 2018, in German (6 pages).

* cited by examiner

Fig. 4
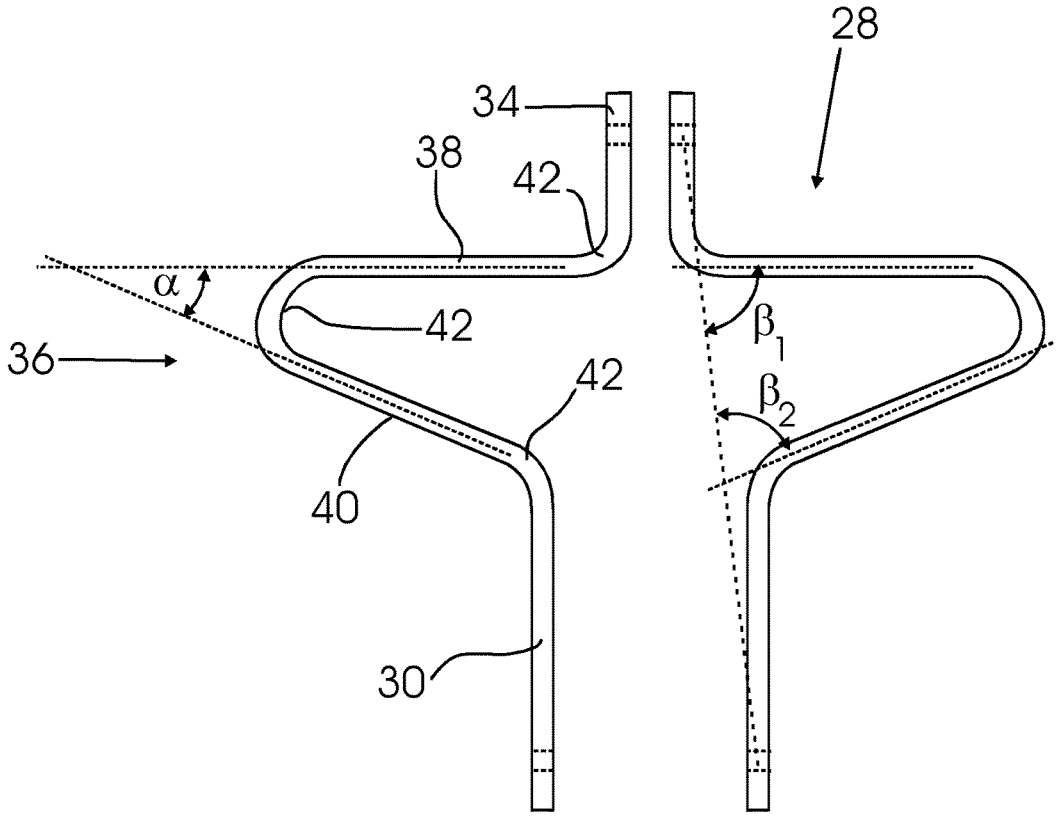
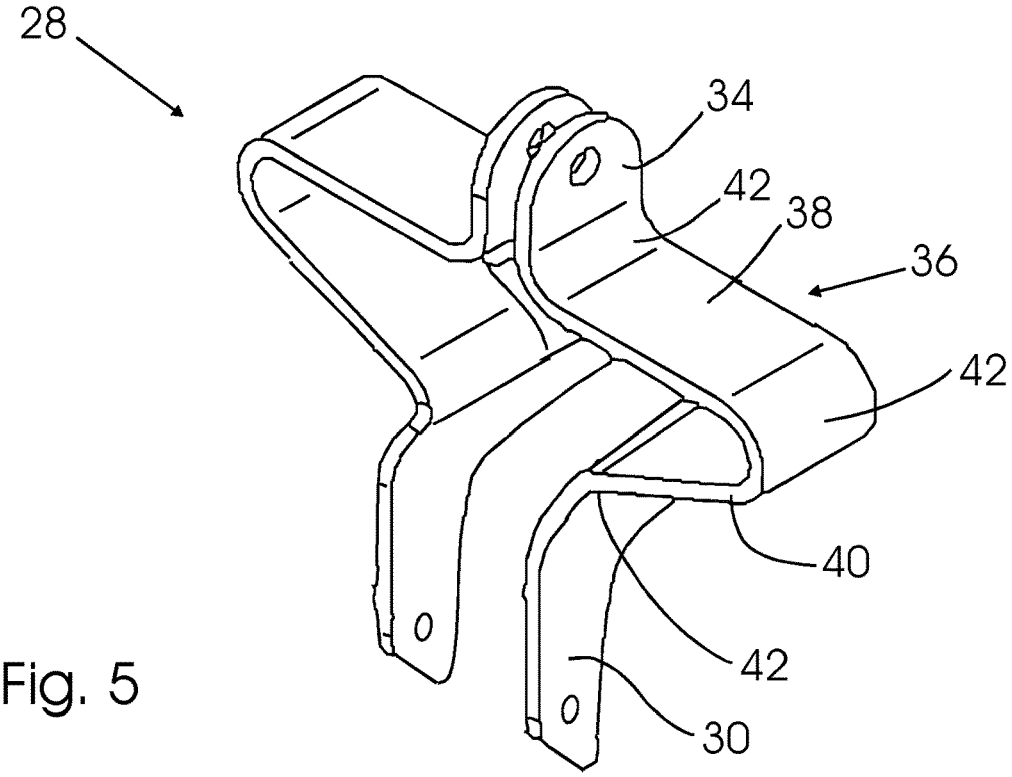
Fig. 5

Fig. 9
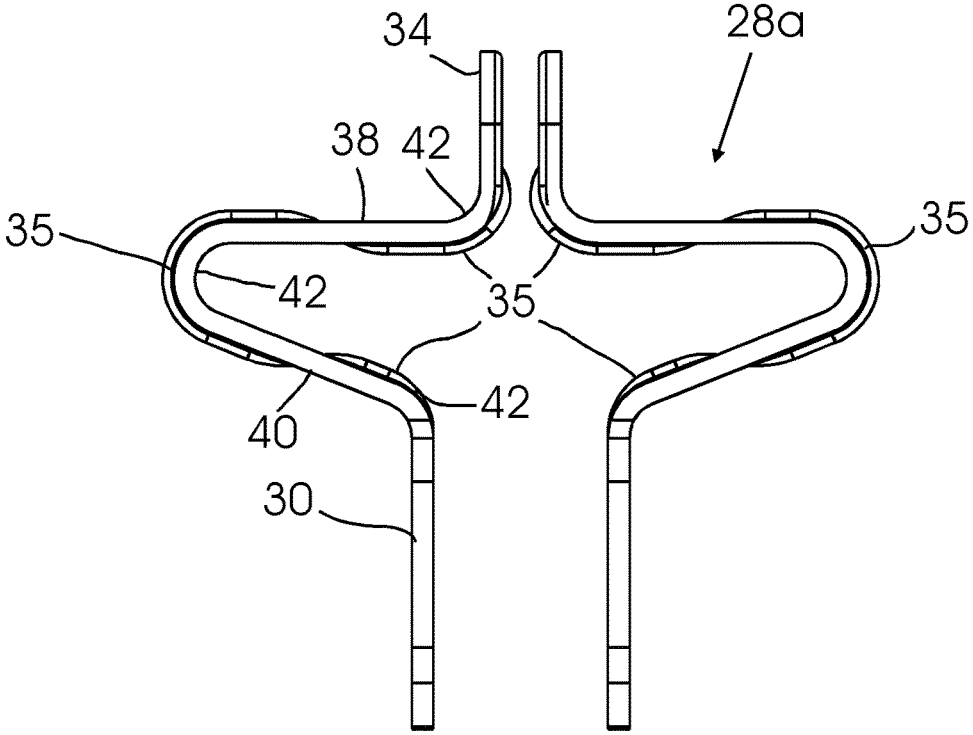
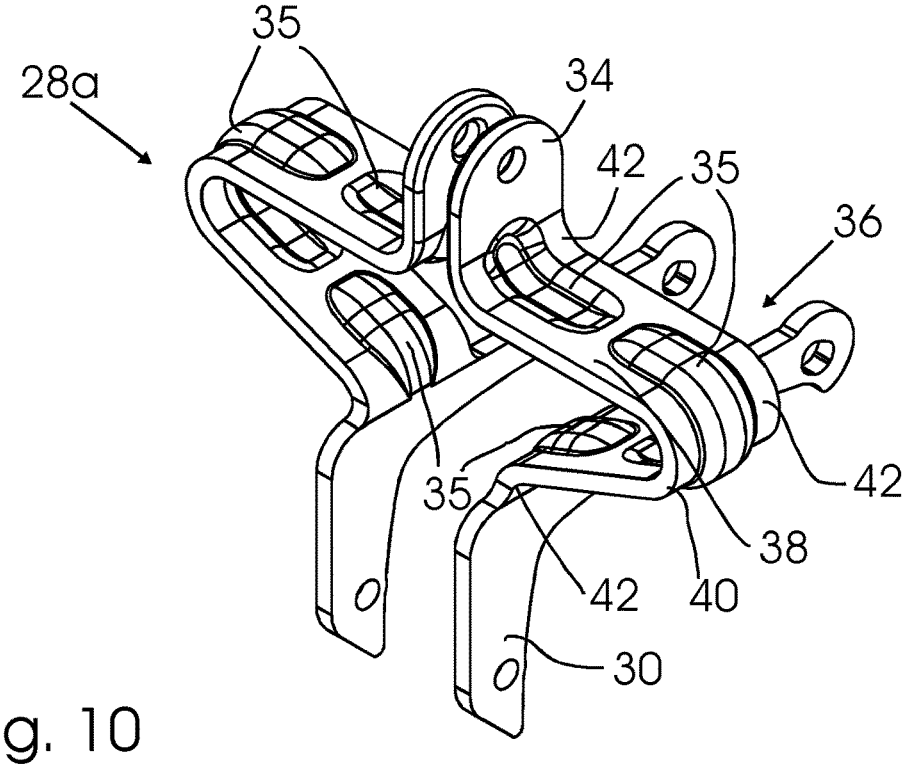
Fig. 10

FALL PROTECTION DEVICE FOR A HOIST

CROSS-REFERENCE TO RELATED APPLICATIONS

This application is a U.S. National Stage of International Application No. PCT/EP2017/079940, filed Nov. 21, 2017, which claims the benefit of German Patent Application No. 10 2016 122 520.7, filed Nov. 22, 2016, both of which are incorporated herein by reference in their entireties.

The invention relates to a hoist, a hoisting device comprising a hoist and a method for securing a hoist.

Hoists are used to lift loads. The hoist itself is arranged on a support device. A drive is used to lift the load, for example by means of a hoist chain or hoist cable.

Various types of hoists are known, e.g., hoists comprising a pneumatic, electric or hydraulic drive. For example, DE 9303916 shows a pneumatically or electrically operable hoist comprising a drive motor, a reduction gear and a chain housing, in which a chain sprocket can be rotated in one direction or the other by means of a motor. A hoist chain is placed over the chain sprocket. The entire hoist is suspended from a component, for example a beam in a hall or a crane hook, by means of a suspension chain and a lug.

The object of the invention can be considered that of proposing a hoist, a hoisting device comprising same and a securing method, by means of which operation that is as smooth as possible is achieved while protection against falling is increased.

This object is achieved by a hoist according to claim 1, a hoisting device comprising same according to claim 13, and a method for securing a hoist according to claim 16. Dependent claims relate to advantageous embodiments of the invention.

A starting point for the invention is the danger of a failure of the hoist suspension means, e.g., due to a defect in the hoist, for example on the hoist suspension means, or on a support structure, for example a ceiling anchor.

A failure of this kind can lead not only to the hoist falling, but also the load suspended therefrom. On the other hand, during use of the hoist, flexible handling and movability on the suspension means is also desirable and necessary for many application scenarios. A second hoist suspension means that is arranged in a completely rigid manner would interfere in this regard.

As is conventional, the hoist according to the invention comprises a hoist body comprising a drive for raising and lowering a hoist chain, a hoist cable or another suspension means for a load. The drive may, for example, comprise a motor, e.g., a hydraulically, pneumatically or electrically operable motor, and if necessary a gearbox and a transmission element to the suspension means, for example a winch, chain sprocket, etc. The hoist chain, hoist cable or other suspension means is used to lift the relevant load, for example using a hoist hook. In this case, the design as a chain comprising individual chain links is preferred. However, a person skilled in the art would recognize that the exact design of the drive as well as of the chain is not essential to the invention, and therefore the term "hoist chain" or "hoist cable" includes any form of flexible, strand-shaped load suspension means.

The hoist body comprises a hoist suspension means, for example a hook, lug, etc., that is attached to the hoist body or connected thereto via a suspension chain, or the like. In this way, the hoist body can be suspended from any type of support device, for example a ceiling, a beam, a crane trolley, a crane, etc. The hoist suspension means may preferably be rotatable, i.e., a revolute joint, for example, may be provided which allows at least one type of limited rotation, preferably free rotation.

According to the invention, a safety device is provided between the hoist body and the support device. The safety device is preferably formed separately from the hoist suspension means. It is designed to suspend the hoist from the support device such that, in the event of release or failure of the hoist suspension means, falling can be prevented. According to the invention, the safety device comprises at least one damping element and a loosely movable coupling element attached thereto.

The coupling element can move loosely. This means that the coupling element enables coupling of two parts without these parts being rigidly fastened or fastened at a fixed distance from one another, but rather the relative position, location and/or orientation of the parts coupled by means of the coupling element can change such that movement is possible. A loosely movable coupling element may itself be rigid, for example, but allow a loose, i.e., movable, attachment to at least one coupling portion, for example by means of a slot. Preferably, the coupling element can itself move loosely, for example in a flexible, bending, translational or articulated manner, etc. Preferably, it can be loaded in a tensile manner, but not in a compressive manner. For example, it may be a chain, a cable or another strand-shaped element.

The damping element, to which the coupling element is attached, is used to partially damp the movement produced when the hoist drops. Damping is in this case understood to mean an at least partially non-reversible conversion—in contrast to a completely reversible conversion, such as in the case of a spring—of at least part of the kinetic energy into another form of energy, in particular heat. The damping may for example be achieved in that friction and/or plastic deformation is produced when a load is acting on the damping element. For example, at least one friction pairing may be provided on which friction is generated during loading—preferably tensile loading—which friction dissipates at least part of the kinetic energy. Friction may for example also be generated within a fluid, for example such that when the damping element is loaded, a gas or liquid is pushed through an opening.

In a currently preferred embodiment, the damping element is a deforming element and comprises at least one deformable deforming portion. This deforming portion is preferably designed and shaped such that, during loading, preferably tensile loading at sufficiently high forces, it deforms, i.e., preferably lengthens.

For example, a deforming element may be designed such that it deforms at forces that correspond at least to the weight force of the hoist body. Usually, however, the deforming forces are significantly higher. For example, the deforming element may be designed such that it lengthens by more than 10% during loading at a force that corresponds to one half of the maximum load of the chain or cable drive. More preferably, plastic deformation is produced during the process. As explained in more detail in the following, the forces occurring during failure of the suspension means are usually very high on account of a certain drop height even if the maximum load is not suspended.

The safety device formed from the damping element and the coupling element is arranged between the hoist body and the support device, the sequence of the elements in principle being selected arbitrarily, i.e., both the damping element and the coupling element may be arranged on the support device or on the hoist body. However, it is preferable if the damping element is attached directly to the hoist body while the coupling element is arranged between the support device and the damping element.

By means of the loosely movable coupling element, the movability of the hoist body on the hoist suspension means can be maintained, such that said coupling element can swing or rotate, for example. A certain degree of movability is also provided in the case of a rigid hoist suspension means, for example a rigidly attached hook that allows a small amount of rotation in addition to swinging movements relative to a load eye in which it is mounted. In the case of a rotatable hoist suspension means, significantly greater angles of rotation are possible. The coupling element is in this case preferably arranged loosely, i.e., such that it is not tensioned. The coupling element and the safety device as a whole are preferably force-free when the hoist suspension means is intact, and therefore do not absorb any tensile forces, such that the full load is suspended from the hoist suspension means. As a result, the movability is maintained; for example, this ensures that a rotation of the hoist body by more than 20°, preferably more than 45°, about a vertical axis of rotation in the hoist suspension means is made possible.

However, in the event of a sudden failure of the hoist suspension means, there is still a certain drop height on account of the movable coupling element and the preferably loose arrangement. The hoist body and whatever load is suspended therefrom may fall by this drop height in the event of the release of the hoist suspension means before the safety device can absorb a tensile force, i.e., before a chain acting as the coupling element or a previously loose cable becomes taut, for example. The acceleration produced by the fall results in high forces when the hoist body is caught. However, the damping element damps the movement, the acting forces preferably occurring over a particular braking distance and force peaks thus being reduced. In the preferred design of the damping element as a deforming element, this happens for example in that the deforming portion deforms under tensile loading. Fall energy can therefore be dissipated by means of plastic deformation.

The hoist according to the invention, the hoisting device equipped therewith and the securing method according to the invention therefore ensure a hoist which is still easy to use, particularly movable in the suspension means, and in which a complete fall of the load can be prevented even in the event of failure of the hoist suspension means even in the case of significant raised loads, with forces occurring during catching being limited.

Thereby the safety device can be designed and attached in a very simple manner, such that little additional constructional outlay is required. As described above, the coupling element may preferably be designed as a cable loop or chain. The damping element can also be designed in a simple manner. In particular, as explained on the basis of preferred embodiments, a deforming element may be provided as a simple part, for example as a bracket-shaped element.

In preferred embodiments, a deforming element may comprise for example two coupling portions arranged at a distance from one another, i.e., at one side for coupling to the coupling element and at the other side for coupling to the support device (or preferably to the hoist body). A deforming portion may be arranged between the coupling portions. In order to allow deformability, the deforming element of the deforming portion preferably comprises at least one deflection, for example a loop, such that it has a shape that is deflected in a transverse direction. A transverse direction is in this case understood to mean a direction which extends transversely to the direction of tensile loading of the safety device, i.e., transversely to an imaginary line that extends between the coupling portions of the deforming element, for example. In a normal vertical arrangement of the deforming element, the deflection therefore extends in a horizontal direction. The deflection in the transverse direction may be formed in any desired shape, for example curved, angular, or a combination of curved rounded portions and straight portions. A deflection that initially moves away from the imaginary line but then moves back towards the line at least in part is preferred.

Shapes in which at least part of the deforming portion extends at an angle of more than 45° to an imaginary line extending between the coupling portions have proven well suitable. In the case of more pronounced bending of 45° or more, not only is there strong deformation during loading, but also significant elongation, meaning that energy is dissipated over a certain distance. Shapes having at least two leg portions that are at an angle of 90° or less relative to one another have proven particularly preferable. During deformation, the leg portions can bend up such that the angle increases, for example until they are completely stretched out, i.e., at an angle of 180°.

It is possible to provide a preferred deflection in the deforming portion merely in a transverse direction; however, a first deflection in a first transverse direction and a second deflection in a second, opposite transverse direction are preferably provided. Particularly preferably, the shape of the deforming element can be symmetrical. The deflections can thereby preferably be arranged one next to the other. In the case of a symmetrical shape, occurring forces can be compensated in the transverse direction, such that swinging movements are reduced.

The safety device is preferably arranged relatively close to the hoist suspension means, but preferably always at a specific remaining distance therefrom, such that there is always a separate attachment that is preferably not affected by failure of the hoist suspension means. For example, the hoist suspension means and the safety device may be arranged substantially centrally with respect to the hoist body. Preferably, the safety device and the hoist suspension means are arranged at least substantially in the extension of the hoist chain or hoist cable.

The deforming element is preferably composed of metal, particularly preferably steel. It may be designed as a flat, curved part, for example. In order to achieve a higher flexural rigidity, at least one bead can be provided at least on the deforming portion. In order to achieve good stability, an integral design of the deforming element between the two coupling portions thereof is preferred, such that no joints or projections, for example, stand in the way of the tensile loading. However, the deforming element may be formed of two or more parallel, separate subelements, in particular subelements shaped symmetrically to each other.

The length of the coupling element may for example be selected such that a rotation of the hoist body about a vertical axis of rotation is made possible. In preferred embodiments, the coupling element may for example have such a length that it becomes taut after a drop height in the region of 20 to 200 mm. More preferably, the drop height is a maximum of 100 mm. It has been shown that a shorter falling distance results in a too low movability of the hoist with respect to the support device in some applications. A higher drop height may under certain circumstances result in excessively strong acceleration, which can hardly be reconciled with the required level of safety.

In the following, an embodiment of the invention is described in more detail on the basis of drawings, in which:

FIG. 4, 5 show a rear and a perspective view of a first embodiment of a damping element on the hoist from FIGS. 1 to 3;

FIG. 9, 10 show a rear and a perspective view of a second embodiment of a damping element on the hoist from FIGS. 6 to 8;

FIG. 11*a*-11*e* show schematic representations of further embodiments of damping elements.

Figure 1:
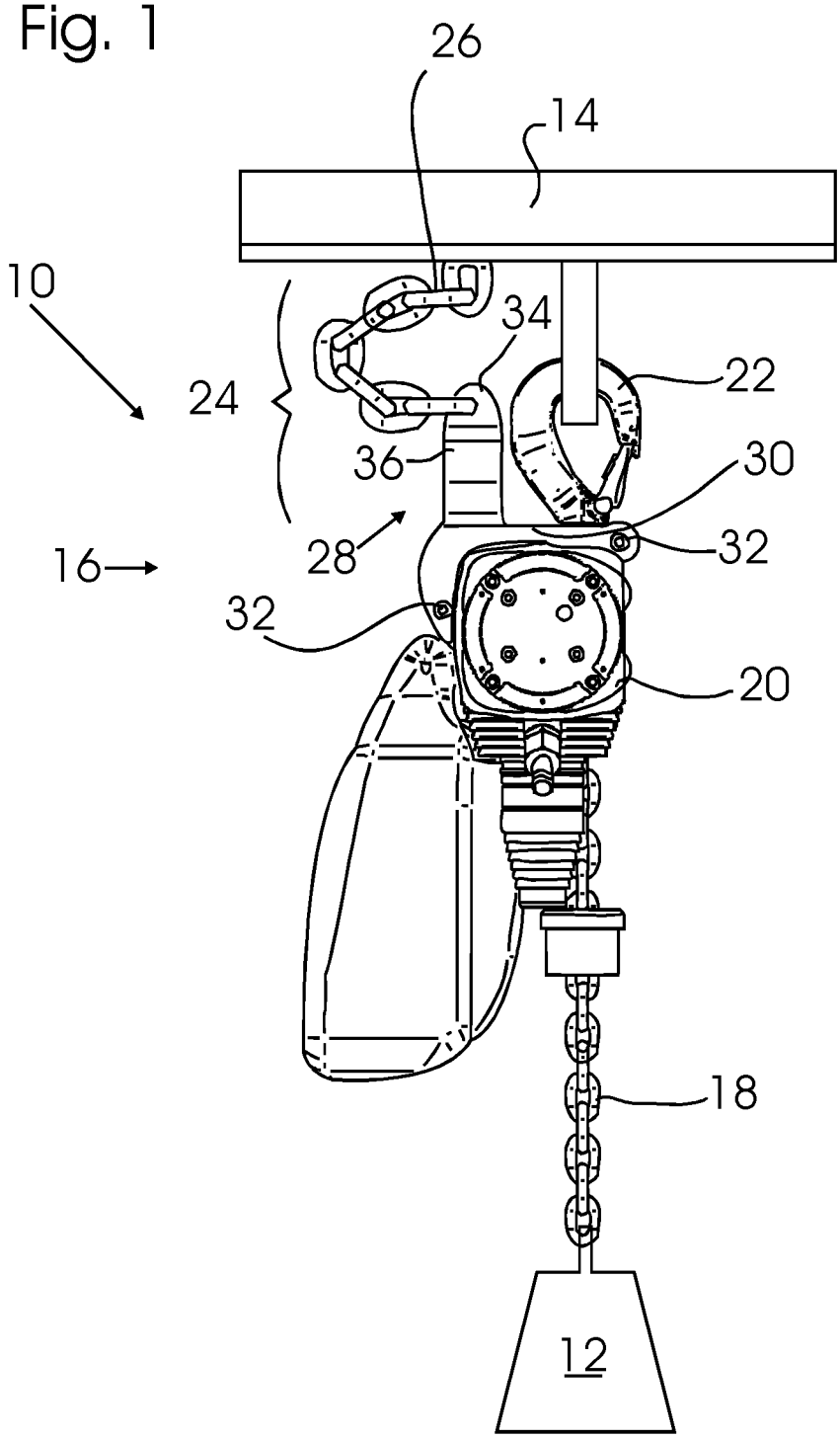
FIG. 1 shows a side view of a first embodiment of a hoisting device comprising a hoist.

FIG. 1 shows a first embodiment of a hoisting device 10 for a load 12, which is shown here in a merely symbolic manner. A hoist 16 is suspended from a support device 14, e.g., a beam, a crane trolley, a crane, or the like, also shown merely symbolically here. The hoist 16 comprises a hoist body 20, for example a housing, in which a drive (not shown here in greater detail) for a hoist chain 18 is arranged, such that, by means of a motor arranged in the hoist housing 20, e.g., a pneumatic, electric or hydraulic motor, the hoist chain 18 can either be drawn in to raise the load 12 or released to lower the load 12.

The hoist 16 comprises a suspension hook 22 having a hook lock for suspension from a part of the support device 14, shown merely schematically here. The attachment of the hoist 16 to the support device 14 enables a certain degree of movability of the hoist 20, inter alia, a rotation thereof. The suspension hook 22 comprises a revolute joint (not shown) in the example shown, such that it is attached to the hoist housing 20 so as to be able to rotate about a vertical axis. However, in alternative embodiments, the suspension hook 22 may also be rigidly attached to the hoist housing 20. In this case, too, a certain degree of movability is afforded to the suspension hook 22 on the support device 14.

In addition, a safety device 24 is provided between the hoist housing 20 and the support device 14. In the example shown, this safety device comprises a safety chain 26 and a damping element, which is designed as a deforming bracket 28 in the preferred embodiment shown.

In the first embodiment, the deforming bracket 28 comprises a lower coupling portion 30, to which said deforming bracket is rigidly connected to the hoist housing 20 using screws 32. The deforming bracket 28 further comprises an upper coupling portion 34 in the form of a lug, to which the safety chain 26 is attached. A deforming portion 36 is formed between the upper coupling portion 34 and the lower coupling portion 30 of the deforming bracket 28. The shape of the deforming bracket 28 is in particular visible in FIG. 4, 5 and is described in more detail below.

As shown, the safety chain 26 is fastened by one end to the upper coupling portion 34 of the deforming bracket 28 and by the other end (shown merely symbolically) to an element of the support device 14. In this case, the safety chain 26 is longer than the distance between the upper coupling portion 34 of the deforming bracket 28 and the attachment point to the support device 14, such that the safety chain 26 is attached loosely between the two points and is force-free. The entire load is received by the suspension hook 22 in normal operation.

The length of the safety chain 26 is such that a rotation of the hoist housing 20 relative to the support device 14 is possible up to an angle of rotation of approx. 180°.

As shown, the safety device 26 is arranged at a short horizontal distance, preferably of a few centimeters, from the hoist suspension means 22. The safety device therefore constitutes an entirely separate second suspension means, albeit not initially under load, in the embodiment shown.

Figure 2:
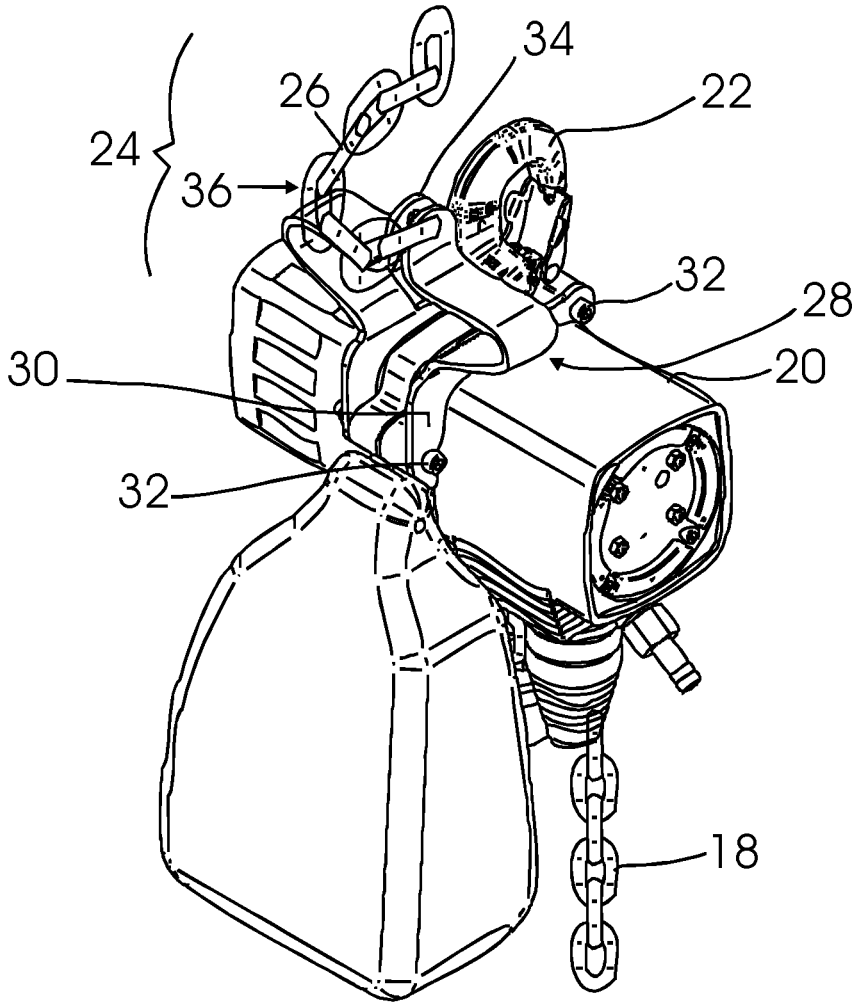
FIG. 2 shows a perspective view of the hoist from FIG. 1.
Figure 3:
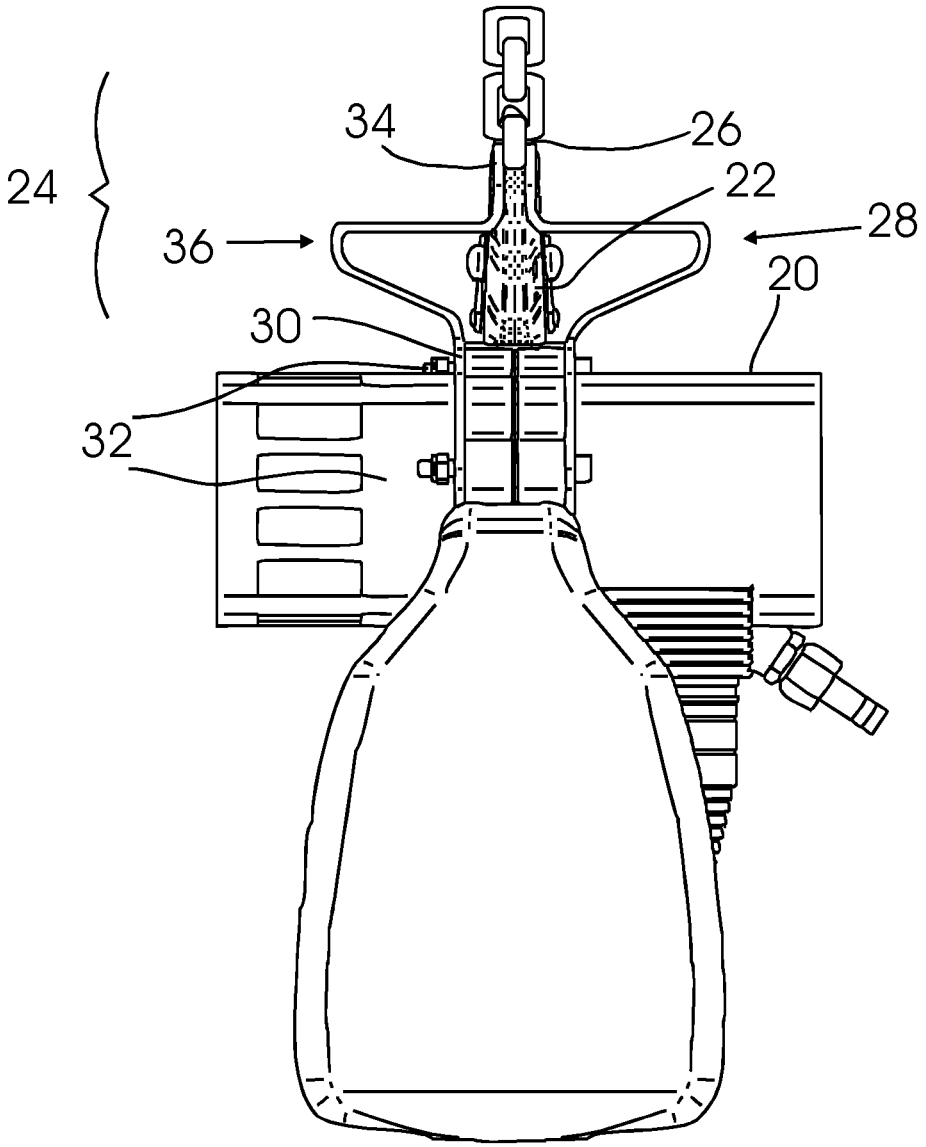
FIG. 3 shows a rear view of the hoist from FIG. 1, FIG. 2.
Figure 6:
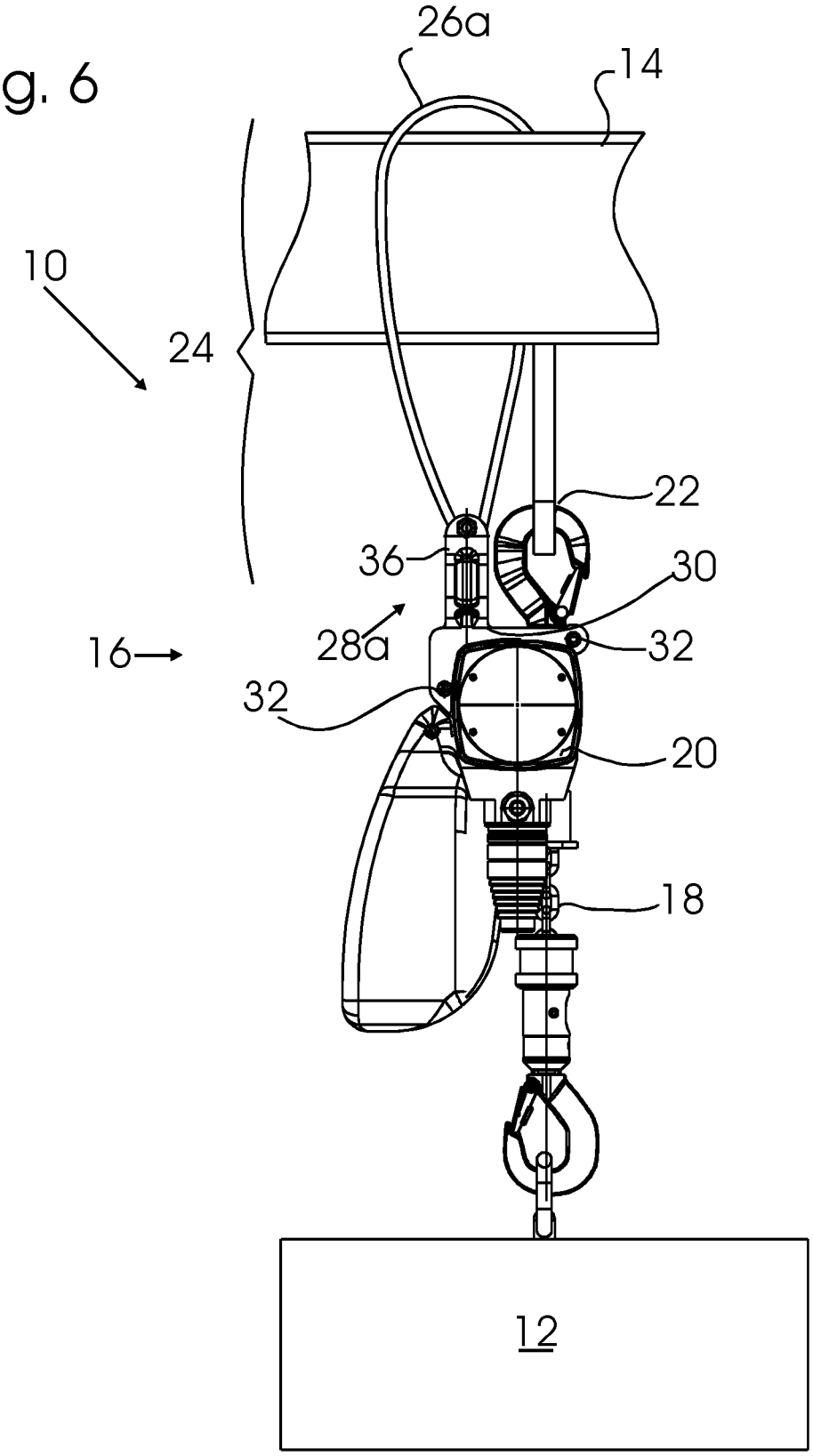
FIG. 6 shows a side view of a second embodiment of a hoisting device comprising a hoist.
Figure 7:
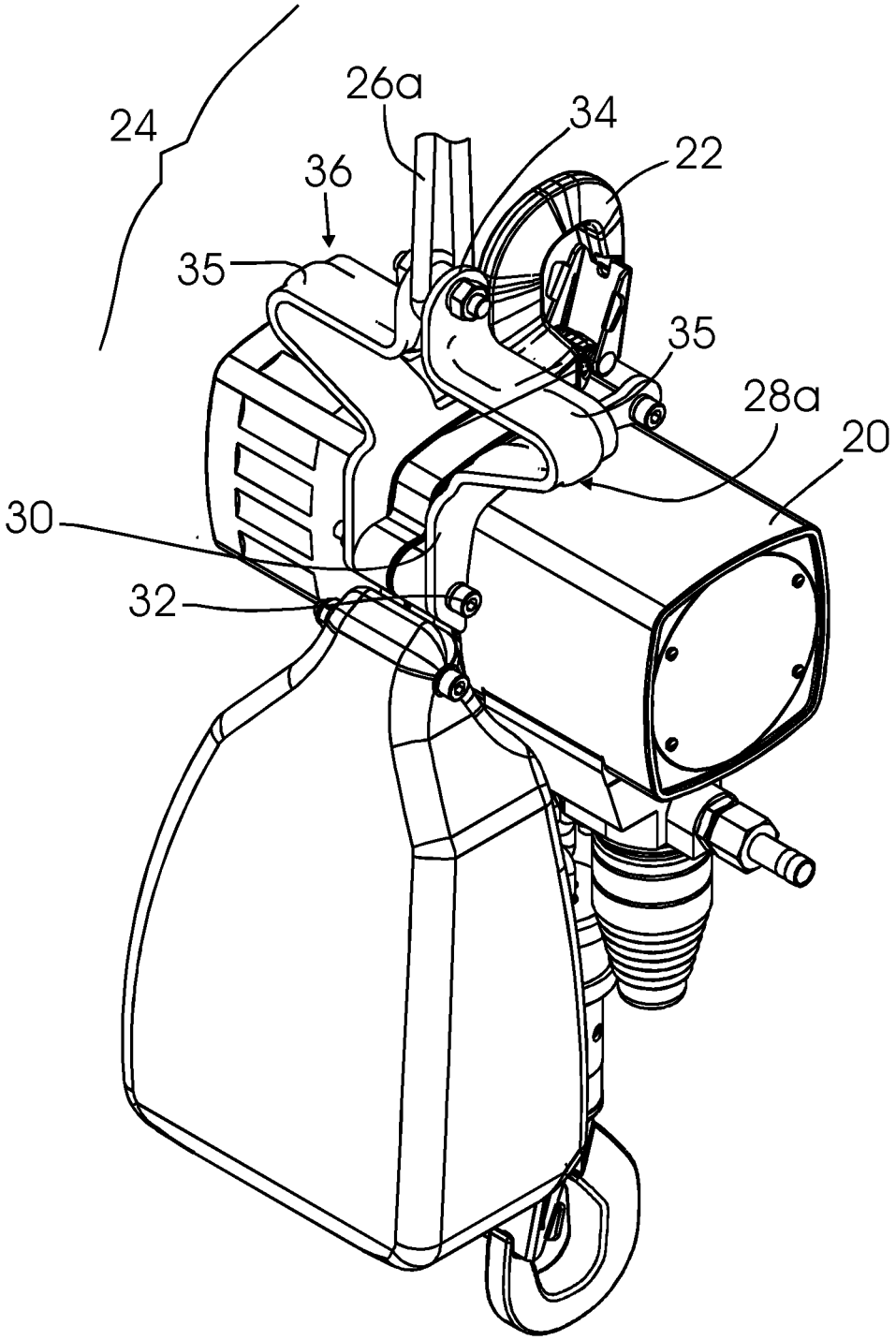
FIG. 7 shows a perspective view of the hoist from FIG. 6.
Figure 8:
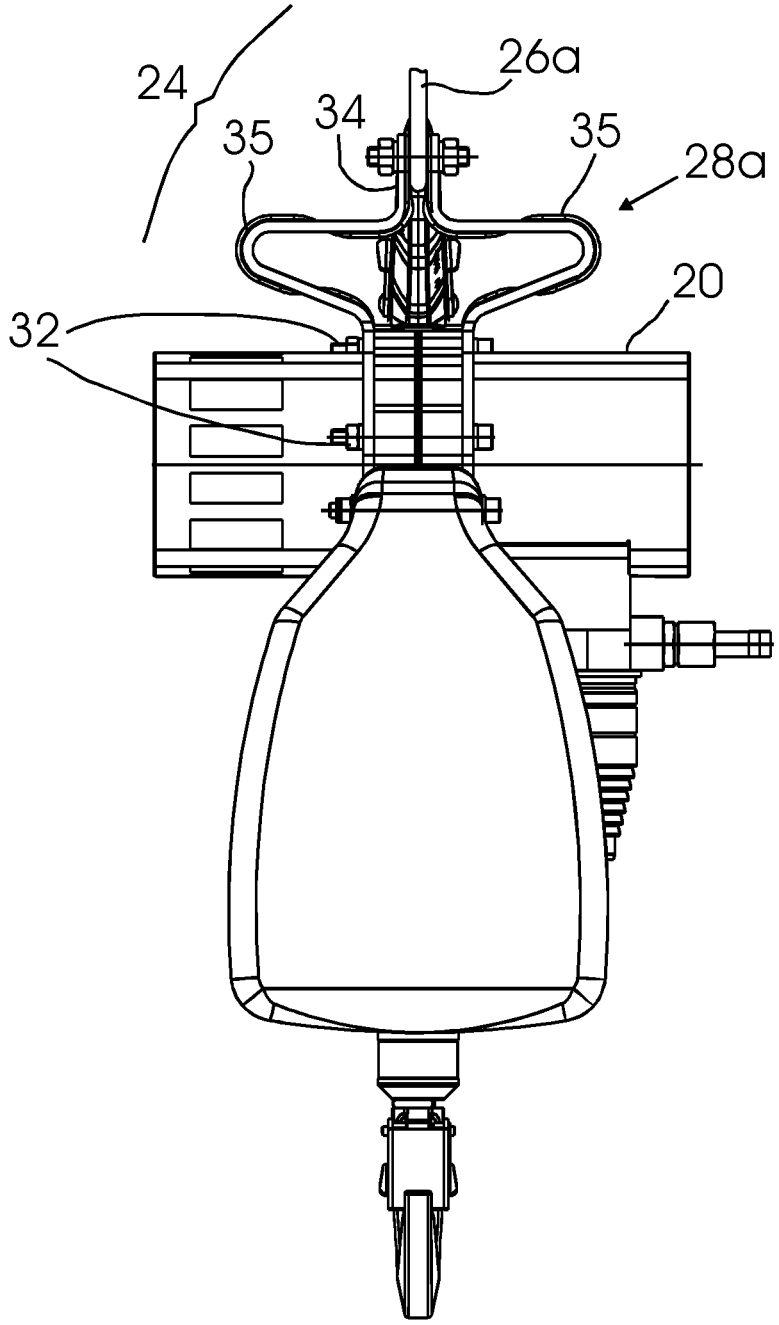
FIG. 8 shows a rear view of the hoist from FIG. 6, FIG. 7.

The hoist 16 and the safety device 24, and in particular the arrangement of the deforming bracket 28 thereon, can be seen in greater detail in the perspective view of FIG. 2 and rear view in FIG. 3. In these cases, the load 12 and the support device 14 have not been shown again.

In the embodiment shown in FIG. 2, FIG. 3, and also in FIG. 4, 5, the deforming bracket 28 is composed of two symmetrical parts which are each formed as bent, flat elements. The lower coupling portion 30 adjoins the housing of the hoist body 20 and partially surrounds same. The deforming portion 36 and the upper coupling portion 34 are integrally formed with the lower coupling portion 30 from a strip-shaped element having a width of approx. 40 mm. The deforming bracket 28 is manufactured from a flat steel material having a thickness of, for example, 5 mm in the example shown. In alternative embodiments, the width and thickness may be selected differently, the thickness values preferably lying within a range of 4 to 8 mm.

As can in particular be seen in FIG. 4, the central deforming portion 36 of the deforming bracket 28 comprises a deflection in the horizontal direction, i.e., transversely to an imaginary line that connects the upper coupling portion 34 to the lower coupling portion 30.

In the deforming portion 36, the deforming bracket 28 comprises an upper, substantially horizontally oriented leg 38 on each of the two sides thereof, which leg extends outward from the upper coupling portion 34, and subsequently, over a bend 42, a second leg 40, which extends from the outside inward.

The deforming portion 36 therefore comprises curves 42, such that the legs 38 are each at an angle $\beta 1$, $\beta 2$ of more than 45° to an imaginary line (shown as a dashed line in FIG. 4), which extends between the coupling portions 34, 30 (more precisely, between the fastening points there).

Both legs 38, 40 are at an acute angle $\alpha$ to one another, which angle is slightly over 20° in the example shown. In total, three curves 42 are therefore formed on the deforming bracket 28 in the example shown.

As already explained, the safety chain 26 can move loosely in normal operation of the hoisting device 10. In the event of failure of the hoist suspension means 22, a certain drop height of the hoist body 20 together with the hoist chain 18 and suspended load 12 is therefore produced, until the safety chain 26 becomes taut. Then, strong tensile loading is produced between the coupling portions 30, 34 of the deforming bracket 28.

On account of the deflected shape, i.e., in the example shown, the horizontal course of the legs 38, 40, i.e., transversely to the substantially vertical tensile loading, the deforming bracket 28 will deform under the sudden tensile loading that occurs after the safety chain 26 becomes taut. In the process, the angle $\alpha$ between the legs 38, 40 widens. The deforming portion 36 thus lengthens, a plastic deformation in particular taking place at the bend points 42.

On account of the deformation upon simultaneous elongation, the fall of the hoist body 20 and the load 12 is caught over a certain braking distance. Although abrupt loading occurs again in both the safety chain 26 and the hoist chain 18 after full elongation of the deforming bracket 28, this loading however is significantly reduced in comparison to a rigid, non-deformable attachment of a safety chain 26.

In one embodiment, the length of the safety chain 26 may for example be dimensioned such that the safety chain 26 becomes taut after a drop height of 60 mm. A load of, for example, one ton would lead to a peak load of approx. 7 t without the deforming bracket 28, which could lead to failure of the hoist chain 18, for example.

On account of a deformation of the deforming bracket 28, which results in an elongation of approx. 60 mm, the peak load can be reduced to approx. 5 t, for example, in otherwise identical conditions. Depending on the geometry and thickness of the deforming bracket 28, other values may also be achieved. As such, by means of an appropriate design, failure of the hoist chain 18 or of other components of the hoisting device 10 or support device 14 can be prevented.

In FIGS. 6 to 10, a second embodiment of a hoisting device comprising a second embodiment of a damping element is shown. In this case, the second embodiment corresponds in many respects to the first embodiment. Identical parts are provided with the same reference numerals. In the following, only the differences regarding the second embodiment with respect to the first embodiment are described. Apart from that the description given above applies to both embodiments.

In the case of the second embodiment, a safety cable 26*a* instead of a safety chain is provided as a component of safety device 24. The safety cable 26*a* is attached to a deforming bracket 28*a* that differs from the deforming bracket 28 according to the first embodiment as described in greater detail below.

The lower part of the safety cable 26*a* is attached to the upper coupling portion 34 of the deforming bracket 28*a*. The upper part of said safety cable forms a cable loop that is placed loosely around the support device 14, i.e., around a beam, in the example shown. The safety cable 26*a* is in this case longer than is required for attachment thereof, such that a rotation of the hoist housing 20 relative to the support device 14 is possible to the same extent as in the safety chain 26, i.e., up to an angle of rotation of 180°.

The deforming bracket 28*a* has the same shape as the deforming bracket 28 according to the first embodiment, i.e., it comprises two symmetrical, curved flat elements having a central deforming portion 36. The deforming bracket 28*a* is also composed of a flat material, preferably steel, however beads 35 are additionally provided on the curves.

In the embodiment shown, the beads 35 are each designed as recesses in the direction of the outer face of the relevant curves.

On account of the beads 35, a higher flexural resistance is produced on the curves of the deforming bracket 28*a*. In the event of a fall, a larger amount of deformation energy can therefore be absorbed in comparison to a curved flat material of the same strength.

While the elements shown are the currently preferred embodiments of the invention, these elements should be understood merely as exemplary and non-limiting. In fact, the invention can be realized by means of a variety of embodiments.

Figure 11A:
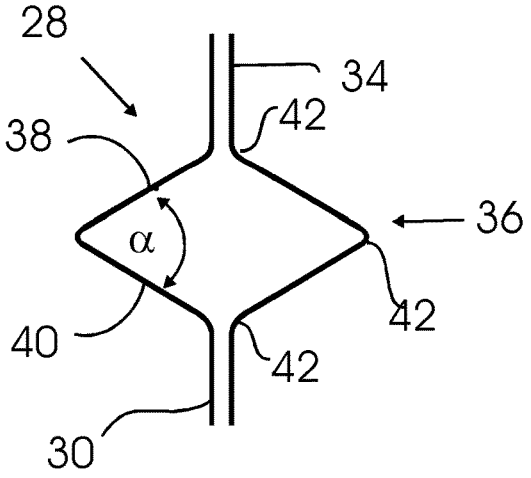
Figure 11B:
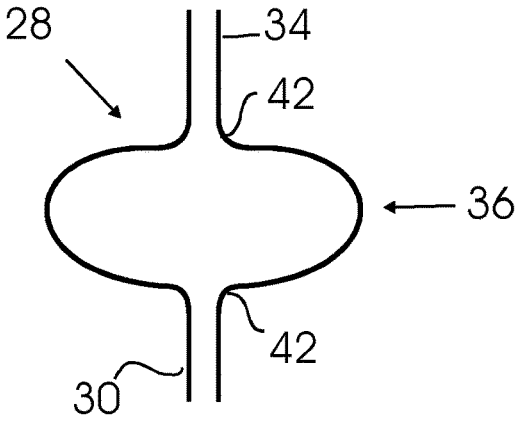
Figure 11C:
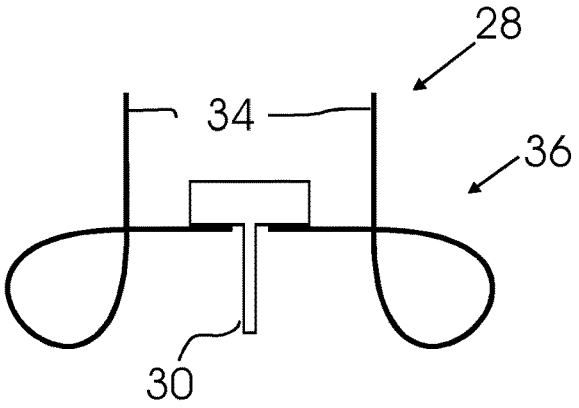
Figure 11D:
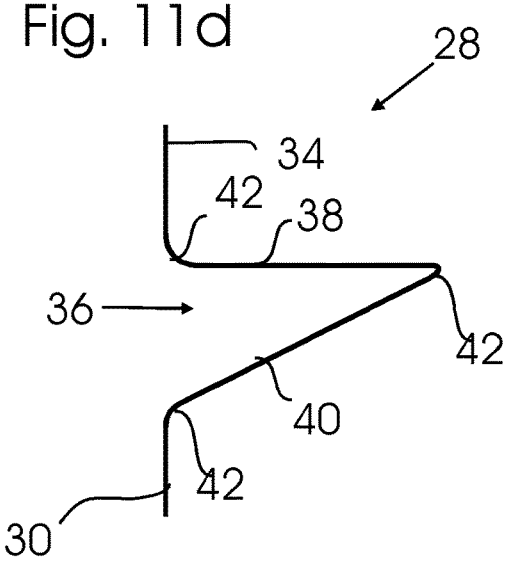

For example, instead of the symmetrical deforming brackets 28, 28*a* shown, an asymmetrical deforming element may be used, as shown by way of example in FIG. 11*d*.

Indeed, the shape of the deforming element may differ significantly. Instead of the depicted shape comprising straight portions 38, 40 and rounded curves 42, purely curved shapes may also be used, for example, as shown by way of example in FIG. 11*b*. Instead of the depicted shape comprising a single deflection in the transverse direction, a plurality of successive deflections may be provided along the course of the deforming portion 36, i.e., a larger number of legs may be provided, for example. Instead of the depicted angles of the individual curves 42, other values may also be selected, such that the legs 38, 40 can be arranged differently relative to one another, as shown by way of example in FIG. 11*a*.

The load acting on the deforming portion 36 of a deforming element 28 is a tensile load in preferred embodiments. However, as the alternative embodiment according to FIG. 11*c* shows, compressive loads may also be produced.

In all embodiments of deforming portions, beads may be provided on the curves in order to achieve greater flexural rigidity.

Figure 11E:
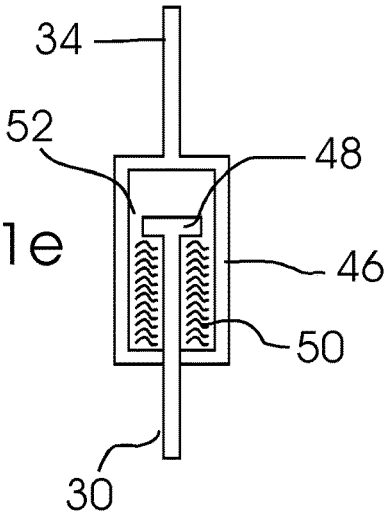

Finally, a damping element may be designed having a friction element instead of a deforming element, as shown by way of example in FIG. 11*e*. Coupling portions 34, 30 are in this example connected to a cylinder 46 and a piston 48. A fluid 50 is arranged in the cylinder 46 and the piston 48 can move inside the cylinder 46 in such a way that, during loading, the fluid is pressed through an annular opening 52 left around the cylinder 48.

Therefore, the damping element shown by way of example in FIG. 11*e* can also damp the falling movement over a braking distance when the load acts on the coupling portions 34, 30.

The invention claimed is:

1. A hoist comprising a hoist suspension means for suspending a hoist body from a support device, wherein a drive for raising or lowering a hoist chain or hoist cable is provided on the hoist body, wherein a safety device, comprising a damping element and a loosely movable coupling element attached thereto, is provided between the hoist body and the support device.

2. The hoist according to claim 1, wherein the damping element comprises at least one deformable deforming portion.

3. The hoist according to claim 2, wherein the damping element comprises two coupling portions arranged at a distance from one another for coupling to the coupling element at one side and to the hoist body or to the support device at the other side, and wherein the deforming portion is arranged between the coupling portions.

4. The hoist according to claim 3, wherein the damping element is shaped such that at least one part of the damping portion thereof extends at an angle of more than 45° relative to an imaginary line that extends between the coupling portions.

5. The hoist according to claim 3, wherein the deforming portion comprises at least two leg portions that are at an angle of 90° or less to one another.

6. The hoist according to claim 2, wherein the drive is designed to lift a maximum load, and the deforming region is designed such that the deforming element lengthens by at least 10% at half of the maximum load.

7. The hoisting device according to claim 6, wherein the coupling element has such a length that the coupling element becomes taut after a drop height of 20 to 200 mm.

8. The hoist according to claim 2, wherein the damping element comprises at least one deflection in the deforming portion, such that the damping element has a shape that is deflected in a transverse direction.

9. The hoist according to claim 2, wherein the damping element in the deforming portion comprises at least one first deflection, wherein the damping element extends so as to be deflected in a first transverse direction, and the damping element comprises a second deflection, in which the damping element extends so as to be deflected in a second, opposite transverse direction.

10. The hoist according to claim 2, wherein the damping element comprises at least one part that extends integrally between an upper and lower coupling portion.

11. The hoist according to claim 2, wherein the damping element is designed as a flat, curved part.

12. The hoist according to claim 11, wherein at least one bead is provided on the deforming portion.

13. The hoist according to claim 1, wherein the coupling element is designed as a chain, cable or other strand-shaped element.

14. A hoisting device, comprising a support device and a hoist according to claim 1, wherein the hoist body is suspended from the support device by the hoist suspension means, and the coupling element has such a length that it is arranged loosely.

15. The hoisting device according to claim 14, wherein the coupling element has such a length that a rotation of the hoist body by more than 20° about a vertical axis of rotation is made possible by the hoist suspension means.

16. A method for securing a hoist, wherein a hoist body comprising a drive for raising or lowering a hoist chain or hoist cable is suspended from a support device by a hoist suspension means, and a safety device comprising a loosely arranged coupling element and a damping element is attached between the hoist body and the support device, wherein, when the hoist suspension means is released, the hoist body falls by a drop height until the coupling element becomes taut, and after the coupling element becomes taut, the damping element damps the fall of the hoist body.

* * * * *